US006543354B1

(12) United States Patent
Straube et al.

(10) Patent No.: US 6,543,354 B1
(45) **Date of Patent: *Apr. 8, 2003**

(54) DEVICE FOR QUICKLY ESTABLISHING A PRODUCTION-RUN STATE IN A PRINTING GROUP OF A ROTARY PRINTING MACHINE

(75) Inventors: Peter Straube, Sinsheim (DE); Rudolf Nägele, Friedberg (DE); Stefan Wasserbaech, Puchheim (DE); Manfred Makosch, Königsbrunn (DE); August Thoma, Bonstetten (DE); Erwin Lusar, deceased, late of Oberottmarshausen (DE), by Ursula Lusar, Markus Lusar, legal representatives; Martin Schmid, Hirblingen (DE); Karl-Heinz Müller, Gersthofen (DE)

(73) Assignee: MAN Roland Druchmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/892,436

(22) Filed: Jul. 14, 1997

(30) Foreign Application Priority Data

Jul. 12, 1996 (DE) ..... 296 12 159

(51) Int. Cl.[7] ..... B41F 13/24

(52) U.S. Cl. ..... 101/247; 101/219; 101/248; 101/182; 101/366; 101/484

(58) Field of Search ..... 101/181, 352, 101/365, 424, 366, 182, 148, DIG. 42, 350.1, 247, 248, 484; 341/23; 400/61, 69, 70, 73, 477, 480; 364/469.02

(56) References Cited

U.S. PATENT DOCUMENTS

| | | | | | |
|---|---|---|---|---|---|
| 4,495,582 | A | * | 1/1985 | Dessert et al. | 101/248 |
| 4,553,478 | A | * | 11/1985 | Greiner et al. | 101/248 |
| 4,660,470 | A | * | 4/1987 | Kramp et al. | 101/365 |
| 4,947,746 | A | * | 8/1990 | Jeschke et al. | 101/181 |
| 4,955,290 | A | * | 9/1990 | Kipphan et al. | 101/365 |
| 4,977,831 | A | * | 12/1990 | Walter | 101/365 |
| 5,010,820 | A | * | 4/1991 | Löffler | 101/365 |
| 5,136,146 | A | * | 8/1992 | Anglin et al. | 235/441 |
| 5,170,711 | A | * | 12/1992 | Maier et al. | 101/365 |
| 5,174,210 | A | * | 12/1992 | Rodi et al. | 101/148 |
| 5,367,982 | A | * | 11/1994 | DeMoore | 101/424 |
| 5,412,577 | A | * | 5/1995 | Sainio et al. | 101/181 |

(List continued on next page.)

FOREIGN PATENT DOCUMENTS

| | | | | |
|---|---|---|---|---|
| CA | 2 123 245 | | 3/1995 | |
| DE | 29 22 964 | | 12/1979 | |
| DE | 29 42 007 | | 4/1981 | |
| EP | 403 861 | | 12/1990 | |
| GB | 2024457 | * | 1/1980 | 101/181 |
| WO | WO 94/29108 | | 12/1994 | |

*Primary Examiner*—Eugene H. Eickholt
(74) *Attorney, Agent, or Firm*—Cohen, Pontani, Lieberman & Pavane

(57) ABSTRACT

A device for quickly and reliably establishing a production-run state in a printing group of a rotary printing machine after the printing cycle has been interrupted. A plurality of freely programmable memory devices having various different printing control programs stored therein may be manually or automatically connected to a control computer that determines which of the preprogrammed control programs are necessary to return the printing machine to a production-run state. The computer then controls the inking unit and, as applicable, the dampening unit in such way that its inking profile for production-run printing is quickly established.

12 Claims, 2 Drawing Sheets

U.S. PATENT DOCUMENTS 5,447,102 A * 9/1995 Pfeiffer et al. ..... 101/148
5,570,633 A * 11/1996 Schultz et al. ..... 101/247
5,584,245 A * 12/1996 Schonberg ..... 101/425 X
5,671,341 A * 9/1997 Kashiwazaki et al. ..... 395/112
5,701,817 A * 12/1997 Thünker et al. ..... 101/484
5,748,484 A * 5/1998 Cannon et al. ..... 365/479.03
5,870,529 A * 2/1999 Kistler et al. ..... 101/365
6,050,192 A * 4/2000 Kipphan et al. ..... 101/181
6,199,480 B1 * 3/2001 Leonhardt et al. ..... 101/181

* cited by examiner

DEVICE FOR QUICKLY ESTABLISHING A PRODUCTION-RUN STATE IN A PRINTING GROUP OF A ROTARY PRINTING MACHINE

BACKGROUND OF THE INVENTION

1. Field of the Invention

The present invention relates to a control device for a rotary printing machine and, more particularly, to a device for quickly establishing a production-run state in a printing group of a rotary printing machine.

2. Description of the Related Art

In web-fed and sheet-fed rotary printing machines, print quality is generally unsatisfactory during initial start-up (either at the start of production or after an interruption in printing). The printed products are typically not printed with the requisite print quality until the printing group achieves a so-called production-run state. Consequently, the quality of the products printed during the initial start-up period of the printing machine will generally be unacceptable. By manually adjusting the setting of the inking unit and, as applicable, the wetting unit, print operators attempt to reduce the amount of broke. Success here depends on experience and on the timely intervention by the operator—both being subjective and susceptible to variation. Furthermore, different interruptions in printing require different adjustment measures. For example, a brief interruption may only cause the inking profile to drift and therefore require only an adjustment to the inking unit. For longer interruptions such as, for example, a plate change, the ink profile set over the breadth of the inking unit can be lost due to lateral spread when the inking unit is positioned away from the printing form, as required to change the plate. After the plate change, there may be a special need for ink and, in some cases, a dampening agent requiring adjustment to the inking and dampening units. Still other conditions prevail after a printing blanket is washed. Furthermore, register marks that are not printed initially may lead to spoilage as the result of the subsequent adjustment of the register.

European Patent Number EP 0 403 861 B1 proposes a process for producing a profile for offset printing machines that approaches production-run printing. According to the proposed process, a control device serves to place the application rollers of the inking and dampening units onto the printing form, permanently or temporarily, during the inlet of ink prior to printing or during an interruption in printing. The control device also reduces the quantity of dampening agent supplied. As a result, the subject matter on the printing plate has a supportive effect on ink distribution. In addition, according to one embodiment, an ink control device can adjust the ink dispensing device. The control device itself is not disclosed in this reference.

SUMMARY OF THE INVENTION

It is accordingly an object of the present invention to provide a device that quickly establishes a production-run state in a printing group of a rotary printing machine after the printing cycle has been interrupted.

The instant invention provides a plurality of freely programmable memory devices having various different printing control programs stored therein. A plurality of switches manually or automatically connect the memory devices to a control computer. Following a printing cycle interruption, the operator or a machine control unit determine which of the control programs are necessary to return the printing machine to a production-run state based on the nature of the interruption, i.e. brief machine shutdown, plate change, printing-blanket washing, etc. A switch is then manually or automatically depressed to connect one of the memory devices to the control computer which then-controls the inking unit and, as applicable, the dampening unit in such way that an inking profile suitable-for production-run printing is quickly established. In this way, the amount of spoilage is minimized.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the drawing, wherein like reference numerals denote similar elements.

DETAILED DESCRIPTION OF THE PRESENTLY PREFERRED EMBODIMENTS

The present invention provides a device for quickly and reliably establishing a production-run state in a printing group of a rotary printing machine. In response to an interruption of the printing cycle, a control program is provided from one of a plurality of memory storage devices to a computer that, in turn, controls the various components of the printing group. A plurality of switches manually or automatically connect the memory devices to the computer. It is thereby possible for the printing group to return to a production-run state expeditiously following an interruption of virtually any duration.

Figure 1:
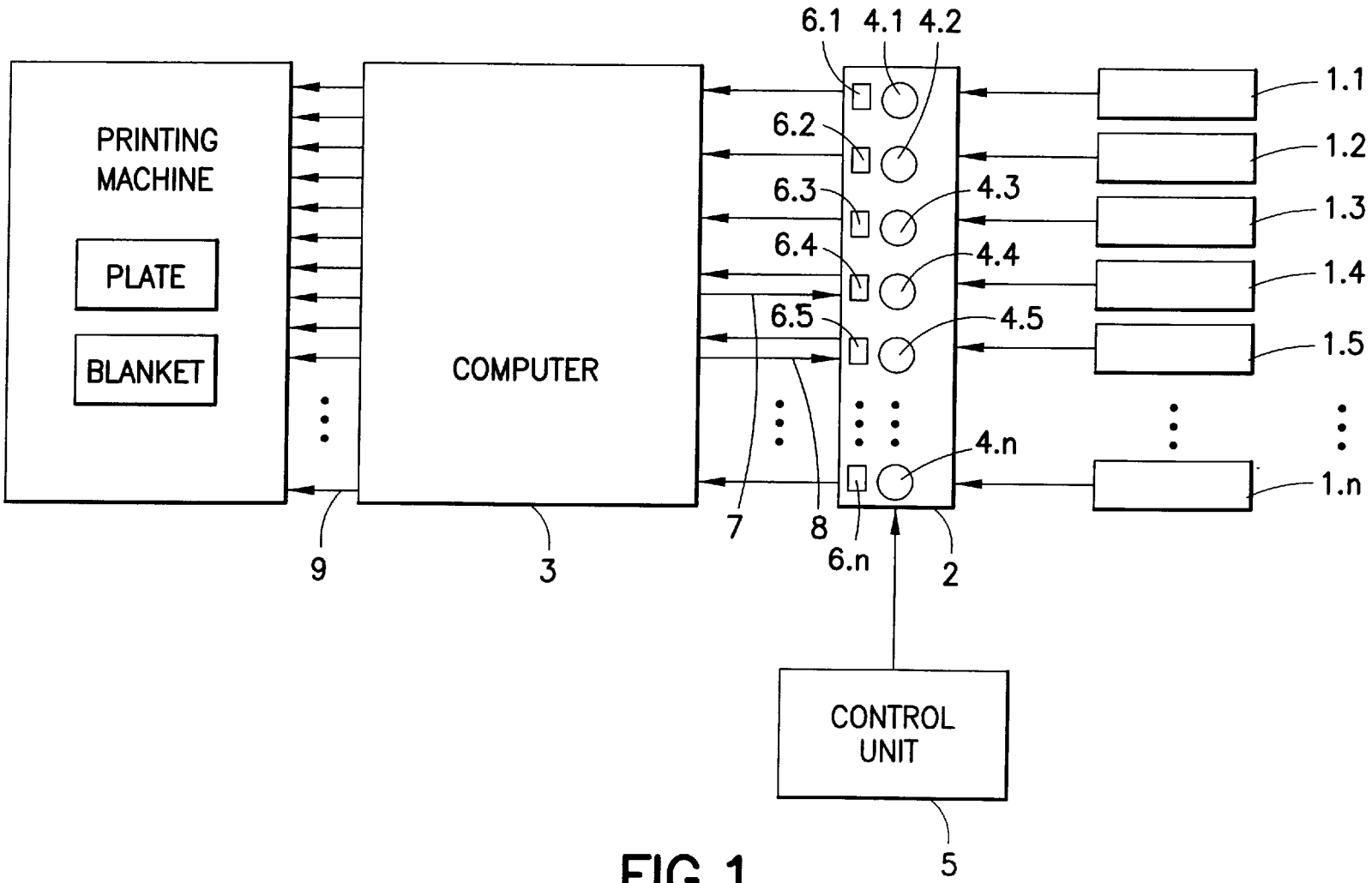
FIG. 1 is a block diagram of a control device according to the present invention including a plurality of programmable memory devices, a machine control unit, and a control computer.
Figure 2:
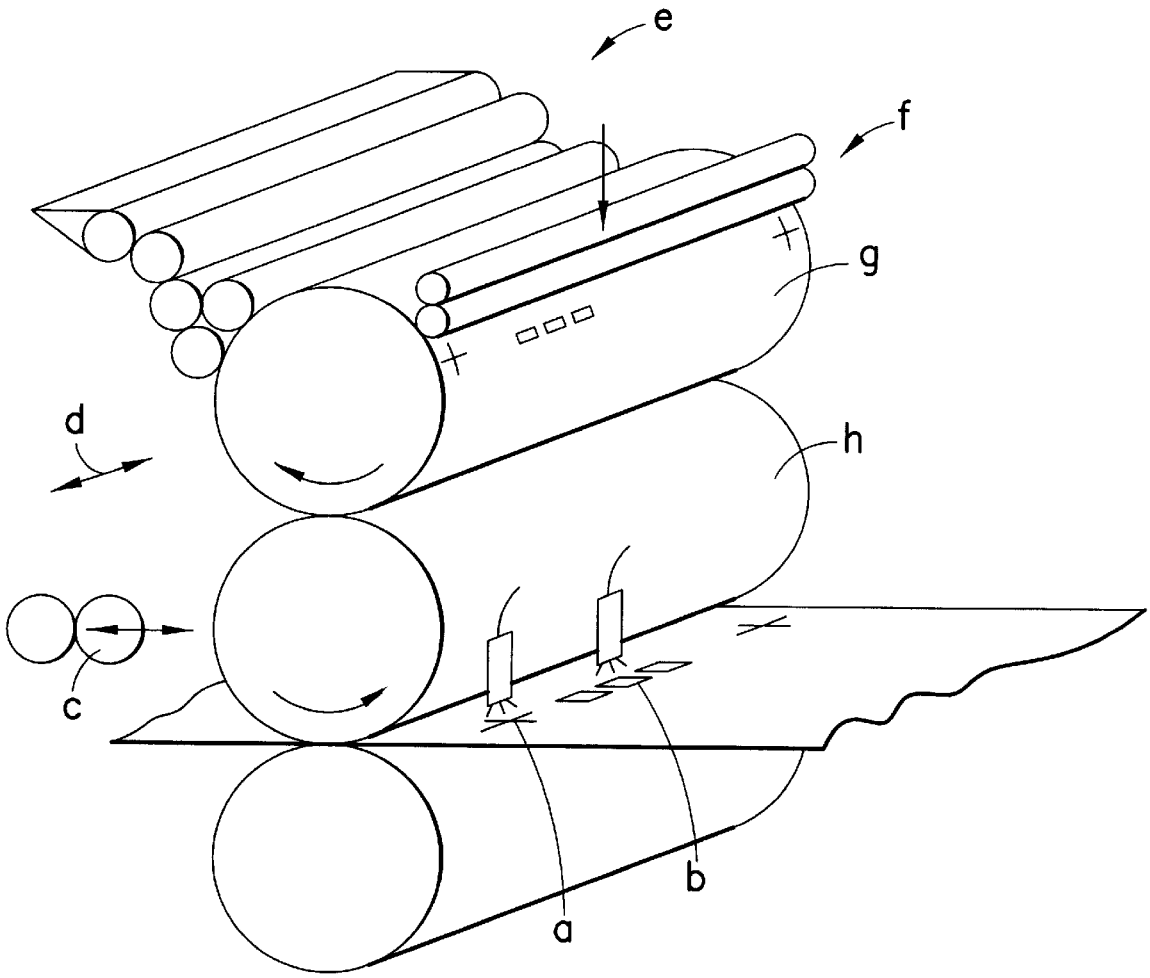
FIG. 2 is a schematic representation of a printing machine.

Referring now to the drawing, a block diagram of the inventive device is depicted in FIG. 1. A plurality of freely programmable memory devices 1.1 to 1.n, are linked via connecting means, including a keyboard unit 2, to the inputs of a control computer 3. The memory devices 1.1 to 1.n may be individually programmed with a plurality of control programs to control the various components of the printing group, e.g. inking unit e, wetting unit f, etc. (See FIG. 2, which also shows the form cylinder g and the transfer cylinder f of the printing machine). A plurality of push-buttons 4.1 to 4.n are located on the keyboard unit 2 and permit the programmable memory devices 1.1 to 1.n to be selectively connected directly to the computer 3. For example, the printer operator may manually depress one of the push-buttons 4.1 to 4.n to connect a specific memory device 1.1 to 1.n to the control computer 3, thereby activating a particular control program in response to an interruption to the printing cycle.

A machine control unit 5 is also connected to the keyboard unit 2. The machine control unit 5 is connected to a plurality of program switches 6.1 to 6.n, preferably electrical or electromechanical switches, located on the keyboard unit 2 and connected in parallel with the push-buttons 4.1 to 4.n. The program switches 6.1 to 6.n automatically connect the memory devices 1.1 to 1.n to the computer, under the control of the control unit 5, in response to interruptions to the printing cycle. Accordingly, either the push-buttons 4.1 to 4.n or the program switches 6.1 to 6.n may be used to connect one or more than one of the memory devices 1.1 to 1.n to the computer 3.

As an example, the control programs for controlling an inking unit e in various process states may be programmed into one or more of the memory devices 1.1 to 1.n. As used herein, the term process states refers to the various operational and resting states of a rotary printing machine. By way of non-limiting example, machine shut-down, printing plate changes, and printing blanket washing are but a few examples of process states for rotary printing machines. It will be obvious to those skilled in the art that rotary printing machines are characterized by other operational and resting states, such other states being contemplated by the present invention.

If the printing machine includes a dampening unit f, control programs for the dampening unit may likewise be programmed into the memory devices 1.1 to 1.n. Each memory device 1.1 to 1.n contains a control program for a particular component or for a particular group of components. In addition, each memory device 1.1 to 1.n contains a control program that will restore the printing group to a production-run state in response to a particular interruption event. For example, memory device 1.1 may contain the control program to return the inking unit e and dampening unit f to a production-run state following a brief machine shutdown. The remaining memory devices, e.g. 1.2 to 1.n, may contain a control program to return the print group to a production-run state following a plate change d, printing-blanket washing c, for printing register marks a, and for printing "print" marks b, for example. It is to be understood that these examples are illustrative and are not intended to define or otherwise limit the scope of the present invention. Accordingly, additional memory devices may be furnished to provide for more or less process states, as desired, and the control program may be stored in any of the particular memory devices.

Regardless of the number of programmable memory devices 1.1 to 1.n provided and of the particular control program included in a particular memory device, the control programs contain the same basic control and switching sequences for the same parameters. For example, the control program may control the 1) adjustment movement of ink zone screws; 2) speed of ink ductor; 3) speed of dampening ductor; 4) connection and disconnection of the film/ink vibrator roller, application rollers, dampening process and printing process; 5) variable, freely programmable time intervals for various program components; and 6) variable, freely programmable number of rotations for individual program components. It is to be understood that the present invention contemplates that the control programs may control more or fewer than the above-described parameters.

In a preferred embodiment, the control program stored in memory device 1.1 may refresh an ink profile without changing the profile, which can be lost during a machine shutdown due to the running or spreading of the ink.

A preferred embodiment may also provide a control program in memory device 1.2 for a plate change, which typically requires that a new plate be activated, i.e. first pre-moistened. In addition, if the plate has a different subject matter, a change in ink profile is required and also provided for by the control program stored in memory device 1.2.

The control program in memory device 1.3 may be required after a printing blanket is washed, in a further example of a preferred embodiment. Taking into account various possible washing methods by means of suitable program design, precautions are taken to ensure that residues of the washing agent do not run back onto the printing plate or into the inking unit.

In a further example of a preferred embodiment, the control program in memory device 1.4 may eliminate the failure to print register marks a. The memory device 1.4 is advantageously activated automatically by the machine control unit 5 when register mark recognition does not occur, i.e. when the printing machine is not printing register marks or when the marks being printed are of unacceptable quality. The control program, stored in memory device 1.4 is thus automatically activated by the program switch 6.4. The circuit connection between the control computer 3, programmable switch 6.4 and memory device 1.4 is indicated by the line 7. The control program in memory device 1.4 ensures more abundant inking in the printing zone of the register marks and supplies, in a chronologically defined manner, the signals needed for an opening adjustment of the relevant ink zone screw. The register marks can be marks for registering the print stock or printed product, for folding and/or cutting or other parameters known in the art. In the case of the folding and cutting register, the early printing of register marks permits the printing group or printing machine to be moved quickly into the register position and thus avoids spoilage of the printed product.

A preferred embodiment may also provide a control program in memory device 1.5 that eliminates a failure to print "print" marks b. Analogous to the above-described control program for memory device 1.4, memory device 1.5 is advantageously automatically activated by machine control unit 5 which may contain, for example, a control circuit that evaluates the print marks. When print mark recognition does not occur, the machine control unit 5 activates the program switch 6.5 to correct this condition. The circuit connection between the control computer 3, program switch 6.5 and memory device 1.5 is indicated by the line 8. This control program ensures more abundant inking in the printing zone of the printing marks and supplies, in a chronologically defined manner, the signals needed for an opening adjustment of the relevant ink zone screw. The printing marks can be an ink absorption mark and an ink balance mark, for example. The early printing of these marks permits printing to be carried out quickly with the desired full tone density, ink balance, etc., and thus reduces the amount of spoilage.

The various memory devices 1.1 to 1.n are assigned process states relative to the control program stored therein and may be connected to the control computer 3 following occurrence of the particular process state. Thus, after a printing cycle interruption, e.g. when the printing machine is initially started or during production runs, after washing, plate change, shutdown, etc., the control computer 3 gains access to the various control programs stored in the plurality of memory devices 1.1 to 1.n by means of a manual or automatic connection between the computer 3 and memory devices 1.1 to 1.n. Manual connection may be effected by operator selection of the proper push-button 4.1 to 4.n on the keyboard unit 2. Automatic connection may be accomplished under direction of the machine control unit 5, that selects the appropriate program switch 6.1 to 6.n, depending on the nature of the interruption and the control program required to restore the print group to a production-run state. For example, after rubber-blanket washing, the program switch 6.3 is selected (in a preferred embodiment).

The particular sets of parameters provided in the control programs of the memory devices 1.1 to 1.n are intended to back up the master functions of the control computer 3. In other words, the control computer 3 provides additional controls to the printing machine and print group, these controls being supplemented by the control programs stored in the memory devices 1.1 to 1.n in the case of a printing interruption. Accordingly, the control computer 3 outputs control signals at its outputs 9 to the adjustment elements (not shown) of the printing groups, such as adjustment motors for the zone screws, ductor driving motors and positioning motors.

The inventive device may be used with sheet-fed or web-fed rotary printing machines for various printing processes, such as relief printing and offset printing.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production run state of the printing machine so as to return the printing group to the production-run state, said connecting means including a keyboard unit for manually connecting said plurality of memory devices to the control computer, one of the plurality of process states of the printing machine is a shut-down state, the printing machine having a changeable plate and a washable printing blanket, wherein a first one of said plurality of memory devices contains a control program for establishing a production-run state following a printing machine shut-down, wherein a second one of said plurality of memory devices contains a control program for establishing a production-run state following a plate change, wherein a third one of said plurality of memory devices contains a control program for establishing a production-run state following a printing-blanket washing.

2. A combination of claim 1, wherein one of said plurality of memory devices includes a control program for controlling the damping unit.

3. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production-run state of the printing machine so as to return the printing group to the production-run state, said connecting means includes a control unit for automatically connecting said plurality of memory devices to the control computer, one of the plurality of process states of the printing machine is a shut-down state, the printing machine having a changeable plate and a washable printing blanket, wherein a first one of said plurality of memory devices contains a control program for establishing a production-run state following a printing machine shut-down, where a second one of said plurality of memory devices contains a control program for establishing a production-run state following a plate change, wherein a third one of said plurality of memory devices contains a control program for establishing a production-run state following a printing-blanket washing.

4. A combination of claim 3, wherein one of said plurality of memory devices includes a control program for controlling the damping unit.

5. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production run state of the printing machine so as to return the printing group to the production-run state, said connecting means including a keyboard unit for manually connecting said plurality of memory devices to the control computer, one of said plurality of memory devices including a control program adapted for use with register marks, said connecting means for one of said plurality of memory devices comprises a control unit adapted to recognize a register mark and to connect said memory device to the control computer if such recognition does not occur, so that the register mark is printed.

6. A combination of claim 5, wherein one of said plurality of memory devices includes a control program for controlling the damping unit.

7. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production-run state of the printing machine so as to return the printing group to the production-run state, said connecting means includes a control unit for automatically connecting said plurality of memory devices to the control computer, one of said plurality of memory devices including a control program adapted for use with register marks, said connecting means for one of said plurality of memory devices comprises a control unit adapted to recognize a register mark and to connect said memory device to the control computer if such recognition does not occur, so that the register mark is printed.

8. A combination of claim 7, wherein one of said plurality of memory devices includes a control program for controlling the damping unit.

9. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production run state of the printing machine so as to return the printing group to the production-run state, said connecting means including a keyboard unit for manually connecting said plurality of memory devices to the control computer, one of said plurality of memory devices including a control program adapted for use with print marks, said connecting means for said one of said plurality of memory devices comprising a control unit adapted to recognize a print mark and to connect said memory device to the control computer if such recognition does not occur, so that the print mark is printed.

10. A combination of claim 9, wherein one of said plurality of memory devices includes a control program for controlling the damping unit.

11. A combination, comprising: a rotary printing machine with a printing group having an inking unit, a dampening unit and being controlled by a control computer, the printing machine being operable in a plurality of process states; and a device for establishing a production-run state for the printing group, said device comprising:

a plurality of freely programmable memory devices, each of said memory devices containing a different control program for controlling the inking unit to establish a production-run state for a respective one of the plurality of process states of the printing machine; and means for connecting one of said plurality of memory devices to the control computer following the occurrence of an interruption in the production-run state of the printing machine so as to return the printing group to the production-run state, said connecting means includes a control unit for automatically connecting said plurality of memory devices to the control computer, one of said plurality of memory devices including a control program adapted for use with print marks, said connecting means for said one of said plurality of memory devices comprising a control unit adapted to recognize a print mark and to connect said memory device to the control computer if such recognition does not occur, so that the print mark is printed.

12. A combination of claim 11, wherein one of said plurality of memory devices includes a control program for controlling the damping unit.

* * * * *